US009086644B2

(12) United States Patent
Fukuda et al.

(10) Patent No.: US 9,086,644 B2
(45) Date of Patent: Jul. 21, 2015

(54) CHARGING DEVICE

(71) Applicant: CANON KABUSHIKI KAISHA, Tokyo (JP)

(72) Inventors: Tadashi Fukuda, Matsudo (JP); Masami Hano, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/055,710

(22) Filed: Oct. 16, 2013

(65) Prior Publication Data

US 2014/0044449 A1 Feb. 13, 2014

Related U.S. Application Data

(63) Continuation of application No. PCT/JP2013/061735, filed on Apr. 22, 2013.

(30) Foreign Application Priority Data

Apr. 27, 2012 (JP) ..... 2012-102485

(51) Int. Cl.
*G03G 15/02* (2006.01)

(52) U.S. Cl.
CPC ..... *G03G 15/0291* (2013.01)

(58) Field of Classification Search
USPC ..... 399/100, 171
See application file for complete search history.

(56) References Cited

U.S. PATENT DOCUMENTS

| | | | | |
|---|---|---|---|---|
| 2008/0226334 | A1* | 9/2008 | Ohno et al. | 399/100 |
| 2009/0136261 | A1 | 5/2009 | Hayashi et al. | |
| 2009/0269105 | A1* | 10/2009 | Hano | 399/171 |
| 2010/0054793 | A1 | 3/2010 | Parks | |
| 2010/0158550 | A1* | 6/2010 | Makino et al. | 399/45 |

FOREIGN PATENT DOCUMENTS

| | | | |
|---|---|---|---|
| JP | 6-016961 | U | 3/1994 |
| JP | 2006-091484 | U | 4/2006 |
| JP | 2008233254 | A | 10/2008 |
| JP | 2009-163206 | A | 7/2009 |
| JP | 2009-265235 | A | 11/2009 |
| JP | 2011209698 | A | 10/2011 |
| JP | 2012-063592 | A | 3/2012 |

* cited by examiner

*Primary Examiner* — Clayton E Laballe
*Assistant Examiner* — Jas Sanghera
(74) *Attorney, Agent, or Firm* — Canon USA Inc IP Division

(57) ABSTRACT

A shutter that suppresses accumulation of discharge products on a photosensitive member is disposed between a grid and the photosensitive member. In this structure, to suppress corrosion of the grid due to the discharge products for a long time, first and second protective layers are provided. The first protective layer is provided on a surface of a base member of the grid that faces the discharge electrode. The second protective layer is provided on a surface of the base member that faces the shutter. The second protective layer is thicker than the first protective layer.

12 Claims, 8 Drawing Sheets

CHARGING DEVICE

CROSS-REFERENCE TO RELATED APPLICATIONS

This application is a Continuation of International Patent Application No. PCT/JP2013/061735, filed Apr. 22, 2013, which claims the benefit of Japanese Patent Application No. 2012-102485, filed Apr. 27, 2012, both of which are hereby incorporated by reference herein in their entirety.

TECHNICAL FIELD

The present invention relates to a charging device which charges a member to be charged.

BACKGROUND ART

A scorotron charger including a grid is known as a corona charger that charges a photosensitive member, which is a member to be charged. There are basically two types of grids. One type is a wire grid that includes wires arranged in an opening in a housing of a corona charger so as to extend in a longitudinal direction. The other type is an etching grid produced by forming many holes in a thin plate by an etching process.

The etching grid covers a larger area of the opening in the housing (has a smaller opening ratio) than the wire grid, and is therefore advantageous in that the potential of a photosensitive member can be easily controlled to a target potential. However, the etching grid more easily allows discharge products generated in a discharge process to adhere thereto than the wire grid.

The discharge products that have adhered to the etching grid (hereinafter referred to as grid) accelerate oxidation of the grid, and rusted parts of the grid have charging characteristics different from those of the other parts. This leads to non-uniform charging. PTL 1 discloses a structure for suppressing non-uniform charging by forming a protective layer, which mainly contains carbon atoms in an SP3 structure, on a surface of a base member of the grid and increasing corrosiveness against the discharge products. PTL 1 also discloses a structure in which the thickness of a protective layer that covers a front surface of the grid that faces a discharge electrode is greater than the thickness of a protective layer that covers a back surface of the grid since the surface of the grid that faces the discharge electrode is easily corroded by the discharge products.

The discharge products that have passed through the grid adhere to the photosensitive member. When the discharge products that have adhered to the photosensitive member absorb moisture, an image defect called "image deletion" occurs. Accordingly, PTL 2 discloses a structure for reducing adhesion of discharge products to a photosensitive member by covering an opening formed in a housing of a corona charger with a shutter.

However, in the case where the opening formed in the housing is covered with the shutter to reduce adhesion of the discharge products to the photosensitive member when the image forming operation is not performed as in PTL 2, the discharge products accumulate on the shutter. It has been found through studies conducted by the inventors that the discharge products that accumulate on the shutter accelerate corrosion of the protective layer on the discharge-electrode side of the grid.

CITATION LIST

Patent Literature

PTL 1 Japanese Patent Laid-Open No. 2008-233254
PTL 2 Japanese Patent Laid-Open No. 2011-209698

Accordingly, an object is to suppress corrosion of a grid due to discharge products for a long time in a structure in which a shutter for suppressing accumulation of the discharge products on a member to be charged is disposed between the grid and the member to be discharged.

Other objects of the present invention will become apparent from the following detailed description with reference to the accompanying drawings.

SUMMARY OF INVENTION

A charging device that charges a member to be charged according to the present application includes a discharge electrode; a housing that surrounds the discharge electrode and has an opening that faces the member to be charged; a plate-shaped grid provided at the opening so as to face the discharge electrode; a shutter capable of covering a space between the member to be charged and the grid; and a moving mechanism that moves the shutter in a longitudinal direction of the grid. The grid includes a base member, a first protective layer provided on a surface of the base member that faces the discharge electrode, the first protective layer protecting the base member, and a second protective layer provided on a surface of the base member that faces the shutter, the second protective layer protecting the base member and being thicker than the first protective layer.

Further features of the present invention will become apparent from the following description of exemplary embodiments with reference to the attached drawings.

DESCRIPTION OF EMBODIMENTS

The schematic structure of an image forming apparatus will be described, and then a charging device will be described in detail with reference to the drawings. Dimensions, materials, shapes, relative positions, etc., of components are not intended to limit the scope of the present invention unless specifically stated otherwise.

First Embodiment

First, the schematic structure of an image forming apparatus will be briefly described, and then a charging device (corona charger) according to the present embodiment will be described in detail.

1. Schematic Structure of Image Forming Apparatus

A section that involves an image forming operation (image forming unit) of a printer 100 will be briefly described.

Schematic Structure of Entire Apparatus

Figure 1A:
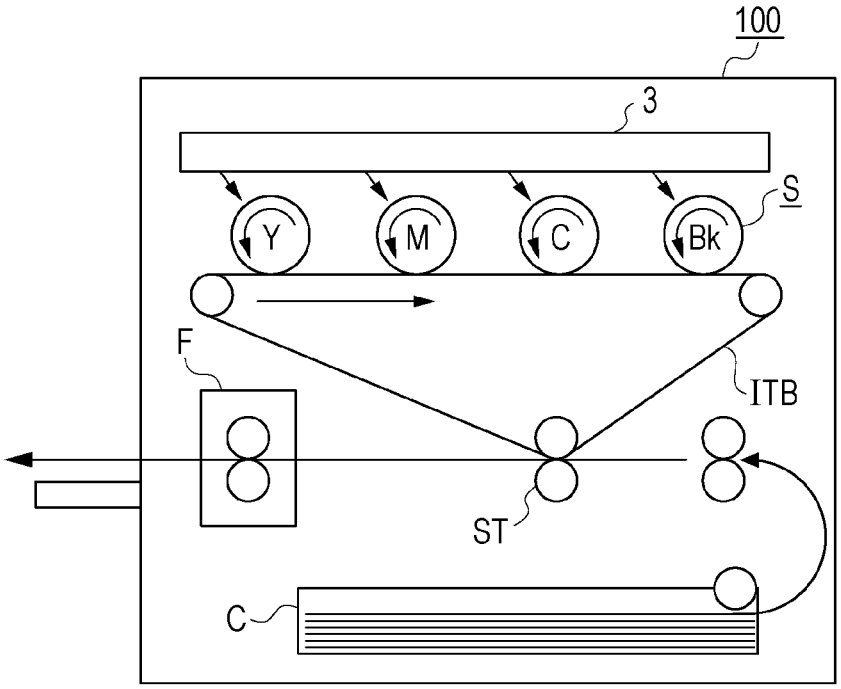
FIGS. 1A and 1B are schematic sectional views of an image forming apparatus.
Figure 1B:
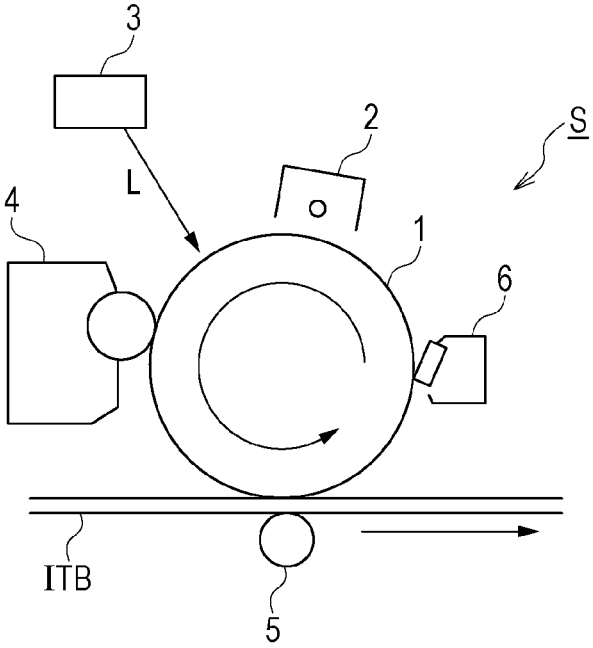

FIG. 1A is a diagram for explaining the schematic structure of the printer 100, which serves as an image forming apparatus. The printer 100 that serves as an image forming apparatus includes first to fourth stations S (Bk to Y) including respective photosensitive drums on which images are formed with different types of toners. FIG. 1B is a detailed enlarged view illustrating the structure of each station, which serves as an image forming unit. The stations are substantially identical except for the types (spectral characteristics) of the toners used to develop electrostatic images formed on the photosensitive drums. Therefore, a first station (Bk) will be described as a representative.

The station S (Bk), which serves as an image forming unit, includes a photosensitive drum 1 that serves as an image bearing member and a corona charger 2 that serves as a charging device for charging the photosensitive drum 1. The photosensitive drum 1 is charged by the corona charger 2, and then an electrostatic image is formed on the photosensitive drum by light L emitted from a laser scanner 3. The electrostatic image formed on the photosensitive drum 1 (image bearing member) is developed into a toner image with black toner contained in a developing device 4. The toner image formed on the photosensitive drum 1 is transferred onto an intermediate transfer belt ITB that serves as an intermediate transfer body by a transfer roller 5 that serves as a transfer member. Residual toner that has remained on the photosensitive drum 1 instead of being transferred onto the intermediate transfer belt is removed by a cleaning device 6 including a cleaning blade. A unit including the corona charger, the developer device, etc., which involve an operation of forming a toner image on the photosensitive drum 1 (photosensitive member), which serves as a member to be charged, is referred to as an image forming unit. The corona charger 2 (charging device) will be described in detail below.

Thus, yellow (Y), magenta (M), cyan (C), and black (Bk) toner images are successively transferred onto the intermediate transfer belt in that order from the photosensitive drums 1 included in the respective stations, and are superimposed on top of each other. The toner images in the superimposed state are transferred onto a recording medium conveyed from a cassette C by a second transfer unit ST. Toners that have remained on the intermediate transfer belt instead of being transferred onto the recording medium by the second transfer unit ST are removed by a belt cleaner (not shown).

The toner images that have been transferred onto the recording medium are fixed to the recording medium by a fixing device F, which contacts and melts the toners to thereby thermally fix the toners to the recording medium. The recording medium to which the images have been fixed is ejected to the outside of the apparatus. The apparatus is basically structured as described above.

2. Schematic Structure of Corona Charger

The schematic structure of the corona charger 2 will be described, and then a shutter opening-closing operation will be briefly described.

Figure 2:
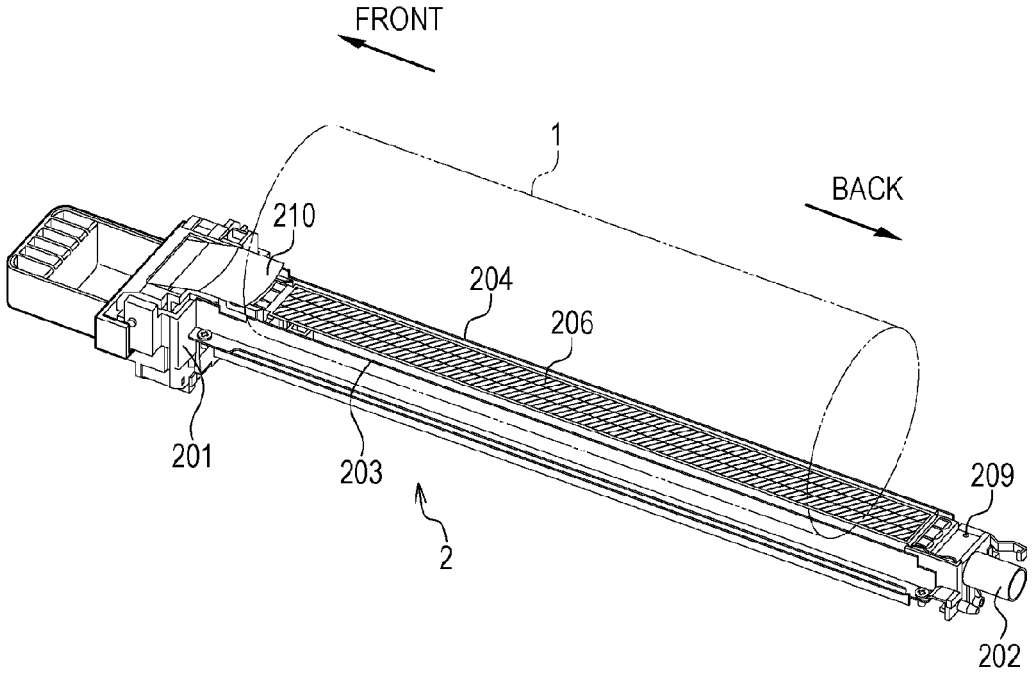
FIG. 2 is a perspective view illustrating the appearance of a corona charger according to an embodiment.
Figure 3A:
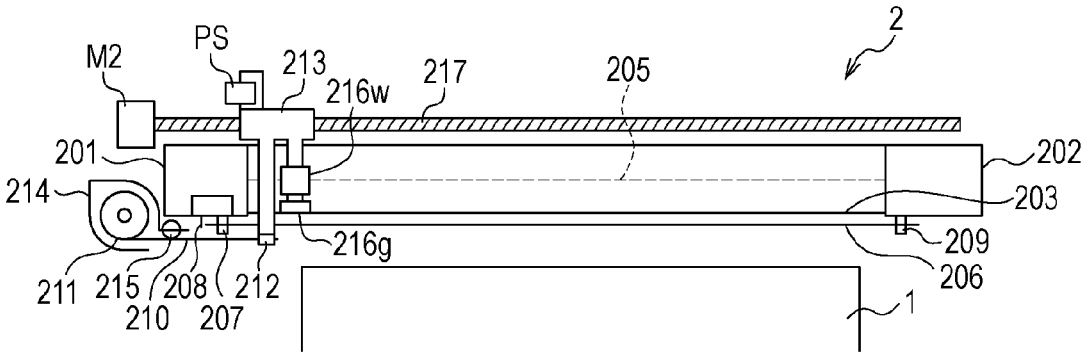
FIGS. 3A and 3B are side views of the corona charger according to the embodiment in the states in which a shutter is opened and closed.
Figure 3B:
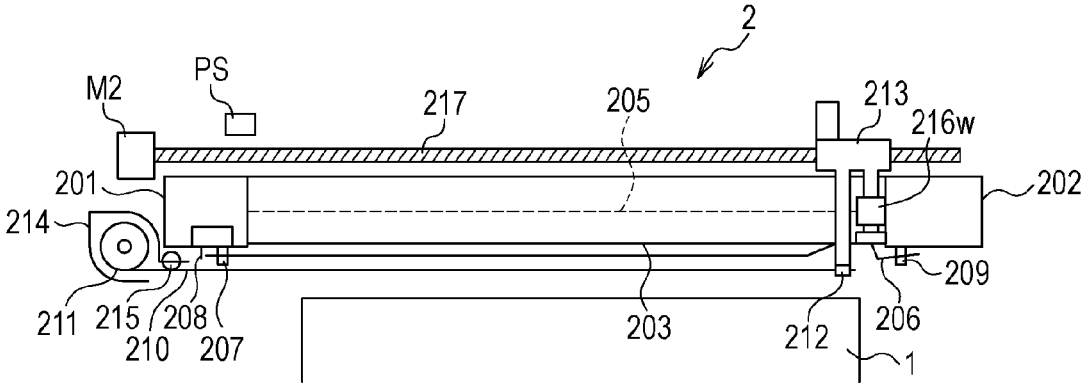

FIG. 2 is a schematic perspective view of the corona charger 2 viewed from the photosensitive member. FIGS. 3A and 3B are side views of the corona charger according to the present embodiment. The corona charger 2 includes a grid 206 and a sheet-shaped shutter 210 capable of covering an opening at a photosensitive-member side (member-to-be-charged side) of the corona charger.

In the corona charger 2, a front block 201, a rear block 202, and shields 203 and 204 form a housing of the corona charger 2. A discharge wire 205, which serves as a discharge electrode, extends between the front block 201 and the rear block 202. When a charging bias is applied to the discharge wire 205 by a high-voltage power supply P, the discharge wire 205 discharges electricity to charge the photosensitive member 1, which serves as a member to be charged. The photosensitive member 1 faces the discharge wire 205 with the grid 206, which is disposed at an opening in the housing, provided therebetween.

Discharge Wire

The discharge wire 205, which serves as a discharge electrode, according to the present embodiment is a tungsten wire having a diameter of 50 μm. The discharge wire may be made of, for example, stainless steel, nickel, molybdenum, or tungsten. Preferably, tungsten, which is a highly stable metal, is used. The discharge wire, which extends inside the shields, may either have a circular cross section or a sawtooth shaped cross section. The structure of each component will now be described in detail.

When the diameter of the discharge wire is too small, the discharge wire will be cut or break due to impact of ions during discharge. When the diameter of the discharge wire is too large, a high voltage needs to be applied to the discharge wire 205 to generate stable corona discharge. It is not preferable to increase the applied voltage since ozone is easily generated. Accordingly, the diameter of the discharge wire is preferably in the range of 40 μm to 100 μm. The discharge wire is cleaned by a cleaning pad 216*w*.

Etching Grid

Next, an etching grid (hereinafter referred to as a grid), which serves as a control electrode and extends in a longitudinal direction of the opening in the corona charger, will be briefly described. In the following description, even when no specific description is given, the grid is a mesh grid having a plurality of through holes that extend therethrough.

The corona charger 2 according to the present embodiment includes the plate-shaped grid 206, which serves as a control electrode, at one of the openings formed between the shields 203 and 204 of the housing, the one of the openings facing the photosensitive member. The grid 206 is disposed between the discharge wire 205 and the photosensitive member 1, and controls the amount of current that flows toward the photosensitive member when the charging bias is applied thereto.

Figure 5:
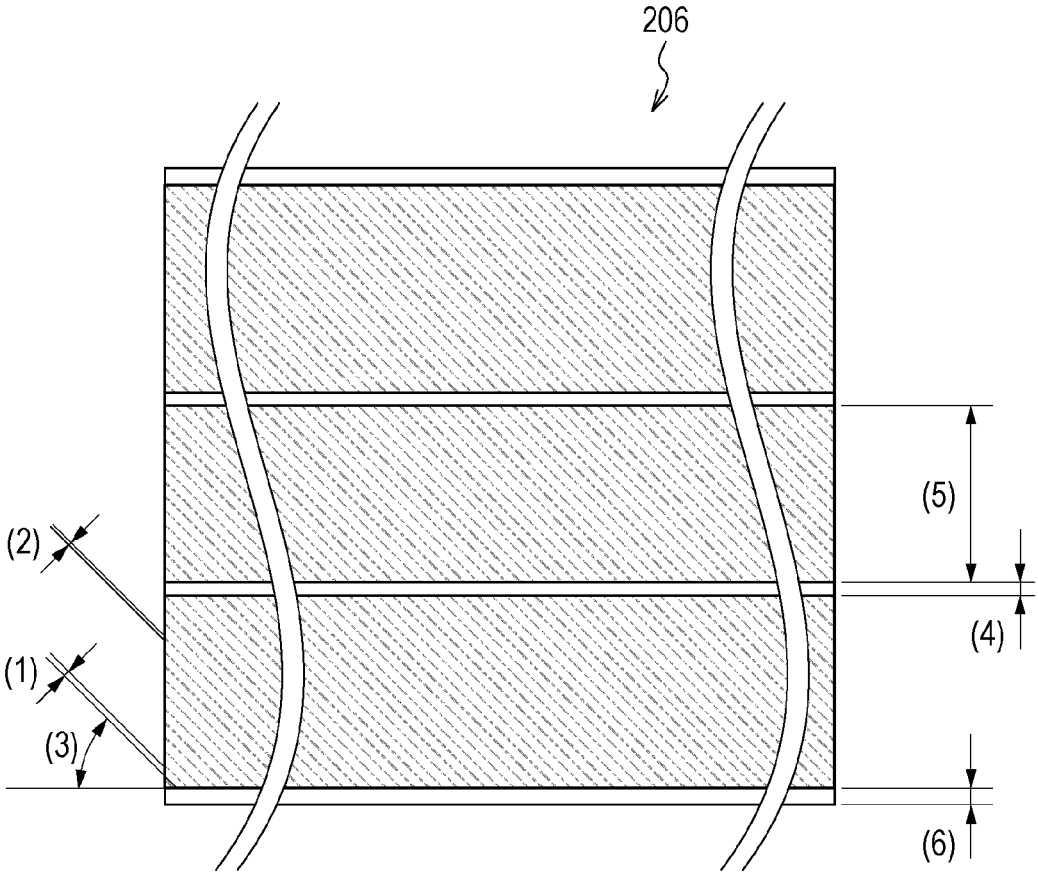
FIG. 5 is a schematic enlarged view of a plate-shaped grid according to the present embodiment.

In the present embodiment, the grid 206 that serves as a control electrode is a so-called etching grid produced by subjecting a thin metal plate (thin plate) to an etching process. The thin plate is a plate-shaped member having a thickness of 1 mm or less. As illustrated in FIG. 5, the etching grid includes beam portions that extend in a longitudinal direction of the grid at both ends of the grid in a lateral direction, and has through holes that obliquely extend between the beam portions. Table 1 shows dimensions of the grid.

TABLE 1

| | |
|---|---|
| (1) | 0.312 ± 0.03 (mm) |
| (2) | 0.071 ± 0.03 (mm) |
| (3) | 45 ± 1 (°) |

TABLE 1-continued

| | |
|---|---|
| (4) | 0.1 ± 0.03 (mm) |
| (5) | 6.9 ± 0.1 (mm) |
| (6) | 1.5 ± 0.1 (mm) |

FIG. 5 illustrates the external shape of the grid. FIG. 5 is an enlarged top view of a part of the grid. The mesh pattern of the grid 206 will now be described.

A central portion of the grid in the lateral direction has a mesh pattern in which lines having a width of 0.071±0.03 mm represented by (2) are formed with intervals having an open width of 0.312±0.03 mm represented by (1) therebetween so as to extend in a direction at an angle of 45±1° represented by (3) with respect to a base line.

To suppress bending of the grid 206, beams having a width of 0.1±0.03 mm represented by (4) are arranged in the mesh section so as to extend in the longitudinal direction of the grid with intervals of 6.9±0.1 mm represented by (5) therebetween. By forming a pattern including through holes having a width of 1.0 mm or less as described above by an etching process, the charge potential of the photosensitive member 1 can be made more uniform. The higher the ratio of the area of the mesh section to that of the through-hole section, the easier the charge potential can be made uniform. The plate-shaped grid is disposed between the discharge wire 205 and the photosensitive drum 1. The effect of making the charge potential of the photosensitive drum 1 uniform increases as the distance between the photosensitive drum 1 and the grid 206 decreases. In the present embodiment, the minimum distance between the photosensitive drum 1 and the grid is 1.5±0.5 mm.

The plate-shaped grid 206 extends between tensioning portions 207 and 209 arranged on the front block 201 and the rear block 202, respectively. The grid 206 can be released from the supported state by operating a knob 208 of the tensioning portion 207 disposed on the front block 201. Thus, the grid 206 can be easily attached and detached (see FIGS. 3A and 3B). The grid 206 is a plate having a curved portion at a position near the tensioning portion 209, and is somewhat stretchable. Therefore, even when the grid is arranged so as to extend in the corona charger, the grid can be moved by a certain distance by applying an external force thereto. In the present embodiment, the base member of the grid is produced by forming many through holes in a thin sheet metal by etching, the sheet metal being made of an austenitic stainless steel (SUS304, hereinafter referred to as SUS) and having a thickness of about 0.03 mm. Although a grid having a mesh pattern illustrated in FIG. 5 may be used as the plate-shaped grid according to the present embodiment, the shape of the grid is not limited to this. For example, a plate-shaped grid having a honeycomb structure described in, for example, Japanese Patent Laid-Open No. 2005-338797 may instead be used. A coating applied to the etching grid to improve, for example, resistance to corrosion will be described in detail below.

In the case where a photosensitive member is charged by using an etching grid, the potential of the photosensitive member accurately converges on the voltage applied to the grid when the dimension of through holes formed in the grid is 1 mm or less. It has been confirmed that the surface potential of the photosensitive member can be appropriately controlled when, for example, the percentage of the area of the through holes formed in the grid by etching in the area of the grid is 95%.

Cleaning Brush

A cleaning brush 216*g*, which serves as a cleaning member for cleaning the grid, will now be briefly described. In the present embodiment, a cleaning brush is provided which cleans a surface of the grid that faces the discharge wire by moving in the longitudinal direction. The brush moves in the longitudinal direction of the grid by receiving a driving force from a motor M2, which is a drive source included in the moving mechanism for opening and closing the shutter.

The cleaning brush 216*g* cleans the grid by moving while an amount by which the cleaning brush 216*g* intrudes into the plate-shaped grid is maintained at a certain value. A holder that holds the cleaning brush is made of an ABS resin.

The cleaning brush 216*g* includes a hair body formed by subjecting an acrylic brush to a flameproofing process and weaving the acrylic brush into a base material. Specifically, the cleaning brush is formed by winding acrylic pile yarns having a thickness of 9 decitex into the base material at a density of 70,000 yarns per inch, and the length of the pile yarns is set so that an amount by which the cleaning brush intrudes into the plate-shaped grid in the cleaning process is in the range of 0.3 to 1.0 mm. The hair body of the cleaning brush may instead be made of, for example, Nylon (registered trademark), polyvinyl chloride (PVC), or polyphenylene sulfide (PPS) resin. Similarly, the cleaning member is not limited to a brush, and may instead be a pad (elastic body) made of felt, sponge, etc., or a sheet to which an abrasive, such as alumina or silicon carbide, is applied.

Charging Shutter

Next, a charging shutter (hereinafter referred to as a shutter) and a structure for retracting and housing the shutter will be described with reference to FIGS. 3A and 3B. The corona charger 2 includes a sheet-shaped shutter 210 that covers an opening (having a width of about 360 mm) in the housing that faces the photosensitive member, which serves as a member to be charged, at least over the entire region (having a width of about 300 mm) of a portion of the photosensitive member on which the images are formed. The shutter 210 moves through a gap between the grid 206 and the photosensitive member 1 to open or close the opening in the housing. In the image forming apparatus according to the present embodiment, when the shutter is in an open state, the minimum distance between the grid 206 and the photosensitive member 1 is as small as about 1.0 mm. Therefore, the shutter 210 is made of soft, flexible sheet-shaped nonwoven fabric so that the photosensitive member is not damaged even when the shutter comes into contact therewith. The width of the shutter in the lateral direction is greater than that of the corona charger in the lateral direction. In the present embodiment, the shutter 210 includes rayon fiber and has a thickness of 100 μm. The shutter may be made of a material formed by weaving nylon fibers, urethane, or polyester as long as it is sheet-shaped.

The shutter 210 is wound into a roll and accommodated by a retracting mechanism 211 for retracting the shutter at an end portion of the corona charger 2 in the longitudinal direction. The retracting mechanism 211 includes a roller to which an end portion of the shutter is fixed and a torsion coil spring that urges the roller. The shutter 210 is urged by the coil spring in a retracting direction thereof (direction for opening the opening), and therefore a central portion of the shutter in the longitudinal direction does not easily become slack.

When a tension is applied to the shutter 210 in the longitudinal direction of the corona charger, a state in which discharge products do not easily leak to the outside through the gap between the shutter 210 and the corona charger 2 can be maintained.

The retracting mechanism 211 is retained by the front block 201 together with a retaining case 214 that retains the retracting mechanism 211. A guide roller 215 that guides the shutter 210 so as to prevent the shutter 210 from coming into contact with an edge of the grid 206, the tensioning portion 207, or the knob 208 of the tensioning portion 207 is disposed near a shutter extracting portion of the retaining case 214.

The other end of the shutter 210 in the longitudinal direction is fixed to a leaf spring 212. The leaf spring 212 retains the shutter and pulls the shutter in a closing direction. In addition, the leaf spring 212 holds the sheet-shaped shutter in an arch shape so as to make the sheet stronger. Specifically, the shutter is held by the leaf spring 212 such that a central portion thereof in the lateral direction is convex toward the discharge wire.

The leaf spring 212, which serves as both a pulling member and a restraining member and which retains the leading end portion of the shutter 210, is connected to a carriage 213 that serves as a moving member included in a moving mechanism. The leaf spring 212 is made of a metal material having a thickness of 0.10 mm. Although the leaf spring 212 is thin, it is strong enough to pull the shutter.

When the carriage 213 is moved backward (in a direction for closing the opening) by receiving a driving force from a screw 217, which is included in the moving mechanism disposed above the corona charger, the shutter 210 is extracted from the retracting mechanism 211. When the carriage 213 is moved forward (in a direction for opening the opening), the shutter 210 is retracted by the retracting mechanism 211 and housed in the retaining case 214. Since the sheet-shaped shutter is caused to pass through a small gap between the corona charger and the photosensitive member, the shutter may contact the grid by accident due to durability or dimensional tolerance.

Shutter Opening-Closing Control

Figure 4A:
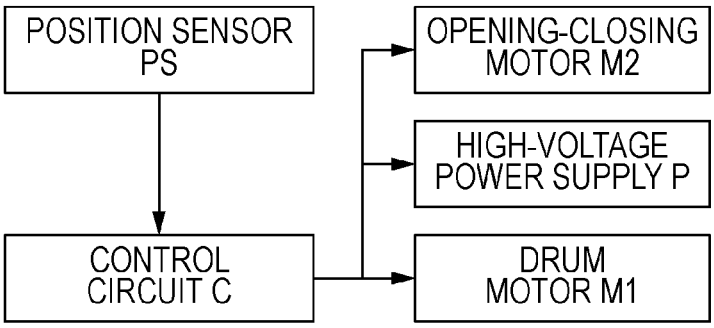
FIGS. 4A and 4B are diagrams for explaining a shutter opening-closing control operation in the corona charger according to the embodiment.
Figure 4B:
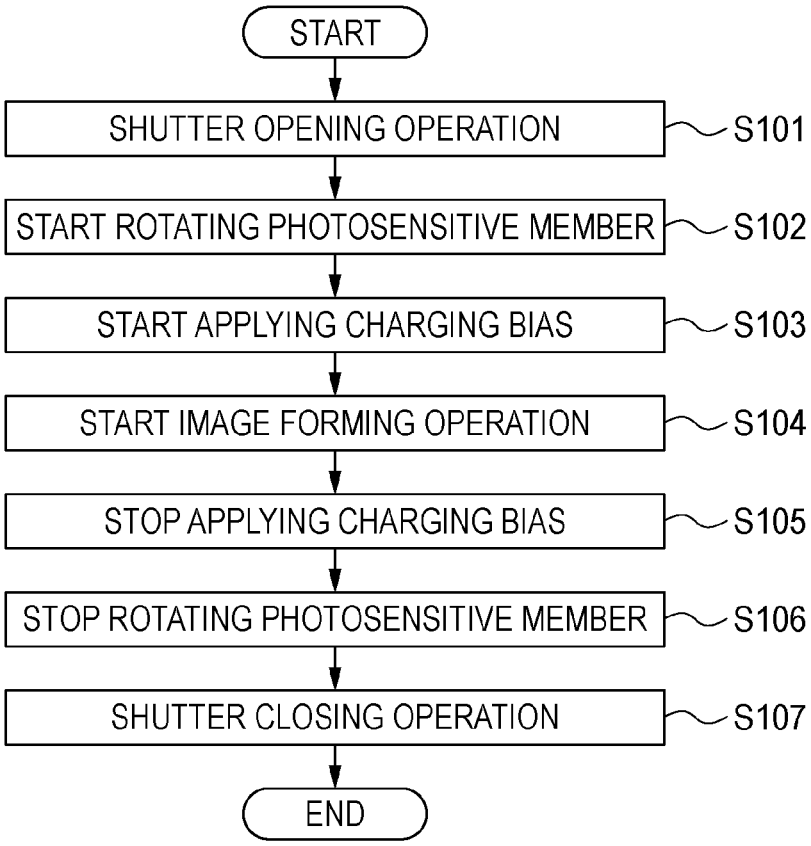

Next, shutter opening-closing control in the corona charger 2 will be briefly described. FIG. 4A is a schematic block diagram illustrating a control circuit, and FIG. 4B is a flowchart of the control operation.

Referring to FIG. 4A, the control circuit (controller) C, which serves as control means, controls the motor M2, the high-voltage power supply P, and a drum motor M1, which serve as drive sources of the moving mechanism, in accordance with a program stored therein. A position sensor PS transmits information regarding presence or absence of a flag to the control circuit C.

When the control circuit C receives an image formation signal, if the outputs from the position sensors show that the shutter is in a closed state, the control circuit C moves the shutter so as to open the opening by driving the motor M2 (S101). Subsequently, while the shutter in a retracted state (while the opening is opened), the drum motor M1 is driven so as to rotate the photosensitive member 1 (S102).

In addition, to charge the photosensitive member, the control circuit C causes the high-voltage power supply S to apply the charging bias to the discharge electrode and the grid (S103).

The photosensitive member 1 that has been charged by the corona charger 2 is subjected to processes performed by the laser scanner, the developing device, and other image forming units so that an image is formed on a sheet (S104). After the image forming operation, the control circuit C stops the application of the charging bias to the corona charger (S105), and then stops the rotation of the photosensitive member (S106).

After the rotation of the photosensitive member has been stopped, the control circuit C rotates the motor M2 in the reverse direction to execute an operation of closing the opening with the shutter (S107). The operation of closing the shutter 210 may either be performed immediately after the image forming operation or after a predetermined time from when the image forming operation was finished.

In the present embodiment, the cleaning brush is moved in the longitudinal direction by the motor M2 that moves the shutter. Therefore, the grid is cleaned in the shutter opening-closing operation. Accordingly, the occurrence of charging failure and non-uniform charging due to dust, toner, external additives, discharge products, etc., that adhere to the grid can be reduced and high-quality images can be formed over a long time.

3. Detailed Description of Coating of Grid

Figure 6:
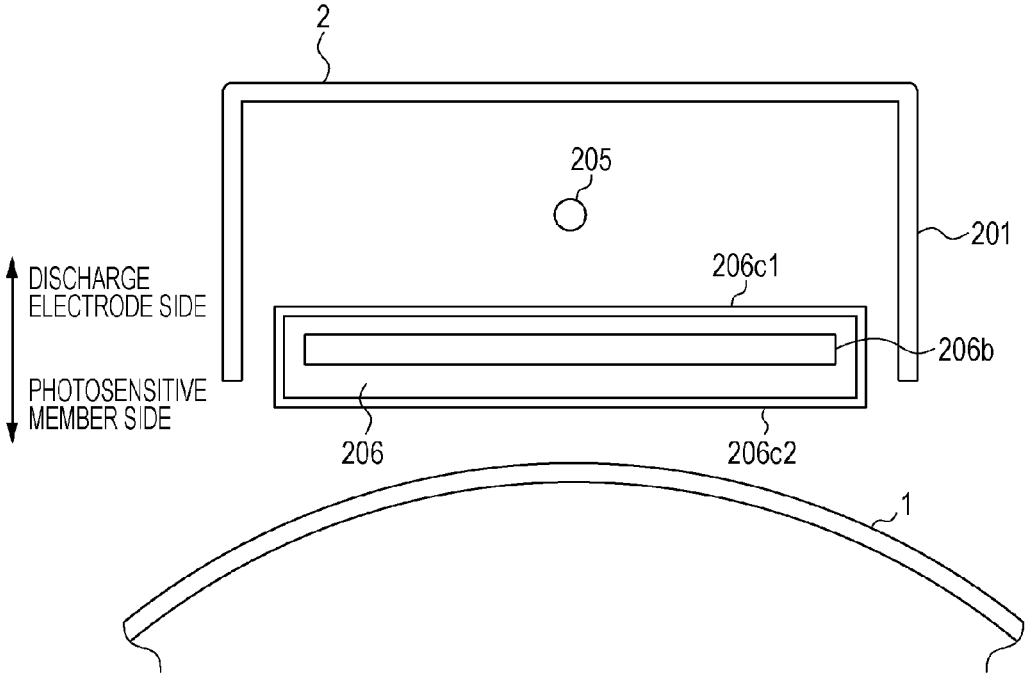
FIG. 6 is a schematic diagram illustrating a cross-sectional structure of the plate-shaped grid according to the present embodiment.

A surface treatment to which the plate-shaped grid 206 according to the present embodiment is subjected will now be described in detail. FIG. 6 is a diagram for explaining the base member and protective layers of the etching grid. Materials of the base member and the protective layers of the grid and a deposition method will now be described.

Base Member of Grid

As illustrated in FIG. 6, the upper side and the lower side of the etching grid 206 in the figure are referred to as a discharge-electrode side and a photosensitive-member side, respectively. In the present embodiment, the base member of the grid is made of SUS. A base material 206*b* may be made of other types of stainless steels such as an austenitic stainless steel, a martensitic stainless steel, or a ferritic stainless steel.

As described above, the discharge products generated through corona discharge act as an oxidizer. Therefore, insulating metal oxide is generated by the discharge products even when the grid is made of a material, such as SUS, that has a relatively high resistance to corrosion. A passive film that mainly contains Cr oxide is formed on the surface of SUS. The passive film blocks the metallic substrate from the outside, and this imparts a relatively high resistance to corrosion to SUS. It is known that this passive film has a self-healing effect and therefore provides resistance to corrosion for a long time.

However, in the case where SUS is used as the material of the grid electrode of the corona charger, the material is exposed to an extremely severe environment (environment in which ozone and NOx densities are high). In particular, in a high-humidity environment, self-healing of the SUS cannot be achieved fast enough to avoid corrosion damage such as rusting. This is probably because metal atoms, such as Cr atoms, included in the passive layer that has been broken by the oxidizers (ozone, NOx, etc.) react with the oxidizers and rusting occurs before self-healing of the passive film is achieved. Specifically, a part of the ozone dissolved in moisture in the air decomposes so that free radicals (OH) are generated, and the SUS is probably oxidized as a result of indirect oxidation reaction of the ozone.

Material of Protective Layers

In the present embodiment, the base member 206*b* (SUS) of the grid is coated with tetrahedral amorphous carbon (hereinafter referred to as ta-C). Here, ta-C is a material that is categorized as a diamond-like carbon (hereinafter referred to as DLC) and that is highly chemically inactive with respect to discharge products.

In general, DLC has an amorphous structure which contains a certain amount of hydrogen and in which diamond bonds (or sp3 bonds) and graphite bonds (or sp2 bonds) are mixed.

Figure 7:
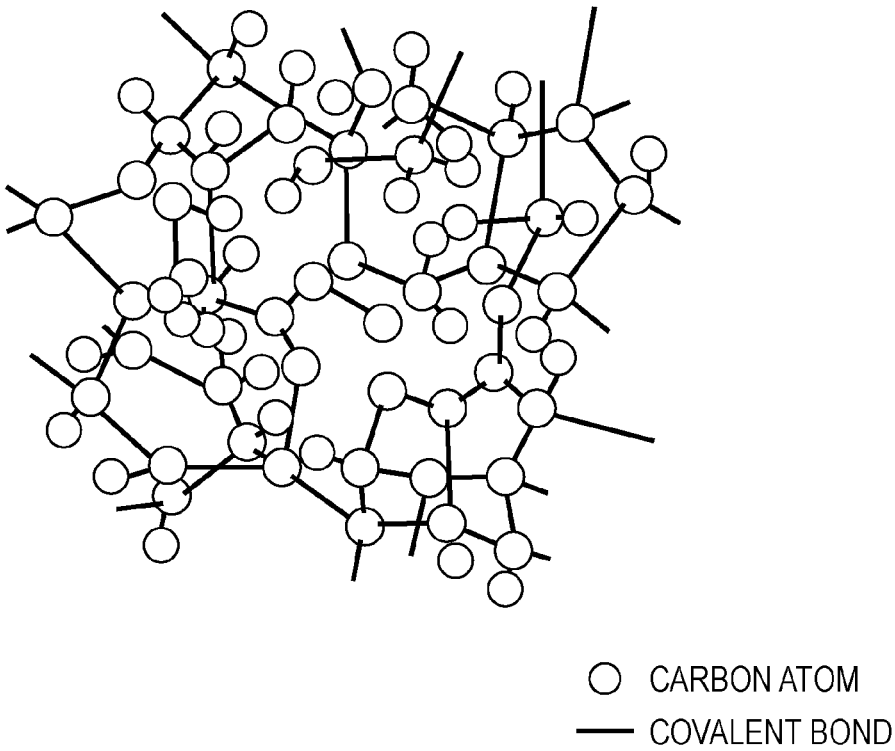
FIG. 7 is a diagram for explaining a ta-C structure according to the present embodiment.

FIG. 7 is a schematic diagram for explaining the structure of ta-C. White circles (○) represent carbon atoms and bars (–) represent bonds. On a microscopic scale, ta-C has a tetrahedral crystal structure. On a macroscopic scale, ta-C is a chemical species having an amorphous structure.

Figure 8A:
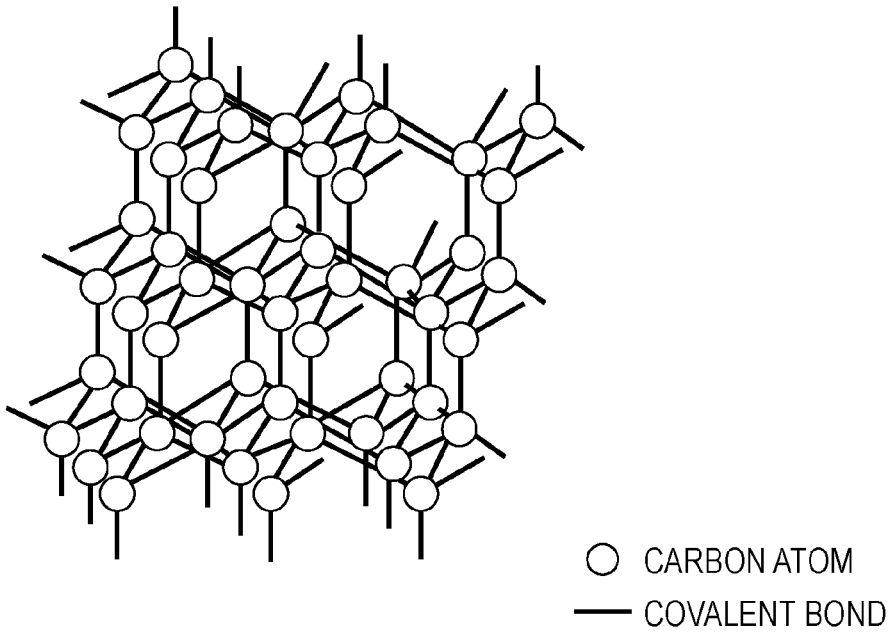
FIGS. 8A and 8B are diagrams for explaining a diamond structure and a graphite structure.
Figure 8B:
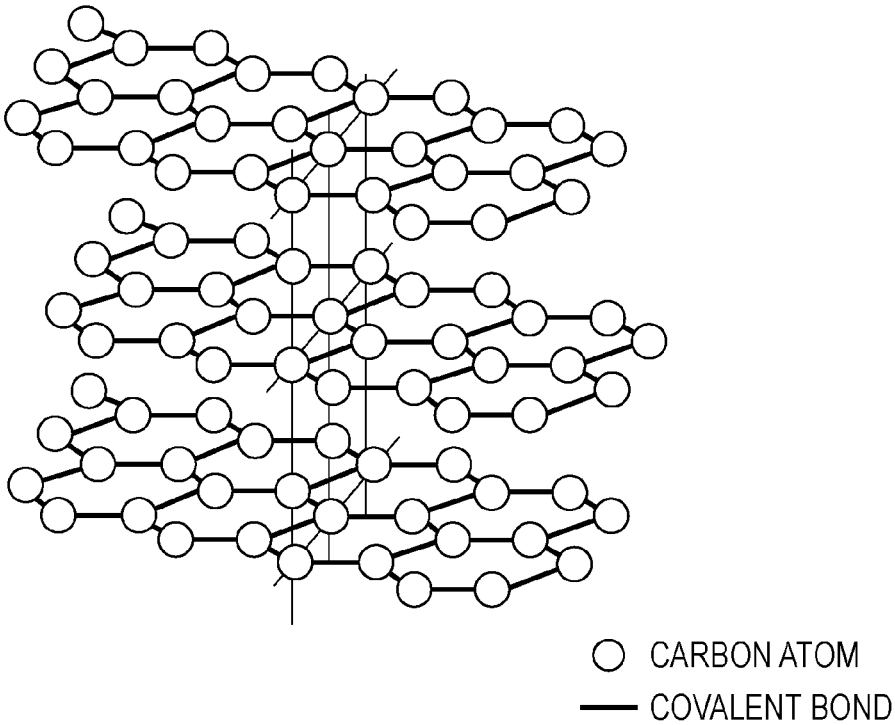

The structure of ta-C is such that sp3 bonds and sp2 bonds are mixed therein, and both the sp3 bonds (diamond structure) that affect hardness and sp2 bonds (graphite structure) that affect sliding properties are included in the composition. Accordingly, resistance to friction and wear properties vary in accordance with the ratio between the sp3 and sp2 bonds. When carbon atoms are crystallized only in sp3 hybrid orbitals, a diamond structure is formed as illustrated in FIG. 8A. Similarly, when carbon atoms are crystallized only in sp2 hybrid orbitals, a graphite structure is formed as illustrated in FIG. 8B.

Compared to other materials, ta-C, which has the above-described structure, has higher inactiveness with respect to air, water, etc., resistance to corrosion, resistance to wear, self-lubricating properties, hardness, and surface smoothness at room temperature. In addition, ta-C does not easily cause chemical absorption, oxidation reaction, etc., and is also resistant to partial functional degradation due to wear or defects.

The volume resistivity, layer thickness, and surface smoothness of the protective layers (ta-C layers) formed on the surfaces of the grid need to be optimized so that the corrosion effect is maximized without adversely affecting the charging performance. The material properties are preferably adjusted so that the volume resistivity is suitable for a charging member of an intermediate resistance. Accordingly, the volume resistivity of the protective layers (ta-C layers) may be in the range of about $1\times10^{7}$ to $1\times10^{10}$ Ω·cm. In the present embodiment, the protective layers (ta-C layers) are formed such that the volume resistivity thereof is in the range of about $1\times10^{8}$ to $1\times10^{9}$ Ω·cm, which is more preferable. In the present embodiment, deposition conditions under which the ta-C layers are formed are selected so that the ratio of the sp3 bonds to the sp2 bonds is 7:3.

Method for Forming Protective Layers

In the present embodiment, the ta-C layers are formed on the base member 206*b* (SUS) of the grid by using filtered cathodic vacuum arc (FCVA) technology. Although ta-C is a coating material that is superior to Cr in, for example, resistance to corrosion, coating methods for ta-C are limited. In general, a so-called vapor deposition (sputtering) method is used to coat a grid electrode with DLC.

Unlike "immersion plating" in which a base member is immersed in plating solution, it is difficult to form substantially identical protective layers on both sides of the grid by vapor deposition. This is because the protective layers are formed by retaining the grid in a low-pressure protective-film-forming chamber and blowing the material of the protective layers toward the grid in one direction. Therefore, it is difficult to form films having substantially the same thickness on both sides of the grid by a single vapor deposition process. Here, thicknesses are regarded as being substantially the same when the difference therebetween is about 10% of the film thickness, that is, about ±5 μm in this example.

The process of forming the protective layers may be referred to as lining, facing, or coating, which are generically referred to as surface treatment in the present embodiment.

To form the ta-C layers on the SUS base member by the FCVA method, carbon plasma is generated from graphite by vacuum arc discharge, and ionized carbon is extracted from the carbon plasma and caused to accumulate on the SUS base member. Instead of the FCVA method, a physical vapor deposition (PVD) method or a chemical vapor deposition (CVD) method may be used.

Formation of Protective Films on Grid

The process of forming the protective layers by a vapor deposition method, such as the FCVA method, has directivity. Specifically, the growth rate of the protective film on a surface toward which protective material is blown differs from that on a surface at the other side. When the thin plate-shaped etching grid that has been subjected to an etching process is used, carbon (plasma) easily flows to the back side through the mesh section.

Therefore, even when the material is blown from one side of the grid, a protective film having a sufficient thickness can be formed also on the back side of the grid. Since the protective material is blown from one side of the grid in the vapor deposition process, the thickness of the protective layer on the front surface toward which the material is blown is greater than that of the protective layer on the back surface. In the case where the material is supplied from both sides of the grid in the vapor deposition process, the cost is higher than that in the case where the material is supplied from one side. Therefore, the cost can be reduced by supplying carbon from one side of the grid and causing the carbon to flow to the back side through the mesh section so that layers are formed on both sides of the grid by vapor deposition. The thicknesses of the protective layers on the front and back surfaces of the grid do not differ by a large amount, and are relatively close to each other. Since the layer thicknesses are proportional to the deposition time, the time required to form the layers increases along with the target thicknesses of the layers. When the deposition time increases, the tact time of the deposition process, of course, decreases, which leads to an increase in cost. The cost can be reduced by stopping the deposition process when the thickness of the layer at the back side reaches the required layer thickness.

Accordingly, the layer thicknesses of the ta-C layers are preferably set so that no deposition defects occur at edge portions of the mesh section (end faces of the thin plate) formed by etching the plate-shaped grid. This is because when deposition defects occur at the edge portions, corrosion current concentrates at the edge portions in the image forming operation. There is a possibility that deposition defects will occur in the regions around the edge portions when the protective layers are formed such that the thicknesses thereof are less than 0.02 μm. Therefore, the thicknesses of the protective films formed on the grid are preferably greater than or equal to 0.02 μm.

Surface Properties of Protective Layer

Next, the surface properties of the grid after the formation of the protective layers (ta-C layers) will be described. When the surface roughness of the ta-C layers increases, the surface area of the ta-C layers formed on the surfaces of the grid also increases. When the surface area of the ta-C layers increases, the possibility that the discharge products, aerosols, and toner and external additives that have been scattered will adhere to the surfaces of the ta-C layers increases.

There is a risk that image defects will occur owing to adhesion of or corrosion caused by the discharge products, aerosols, and toner and external additives that have been scattered on the surfaces of the ta-C layers. Therefore, the surfaces of the ta-C layers are preferably smoothed.

The cleaning brush, which serves as a cleaning member for cleaning the grid, comes into contact with the grid according to the present embodiment. To reduce wear on the protective layers due to contact with the cleaning brush, the surfaces of the protective layers are preferably smooth. Various materials may be used as the material of the surface layers of the plate-shaped grid. However, the ta-C layers have a high resistance to wear as described above, and are therefore preferable as the material of the protective layers of the grid that cause contact friction against, for example, the cleaning member. The smoothness of the ta-C layers formed on SUS is easily affected by the surface roughness of SUS that serves as an underlayer.

The surfaces of the ta-C layers are preferably formed so that the arithmetical mean height Ra defined by JIS-B0601:2001 is 2.0 μm or less. When the surfaces of the ta-C layers are such that Ra is 1.0 μm or less, adhesion of the external additives can be suppressed, even though the deposition cost increases in such a case. In the present embodiment, the ta-C layers are formed on the grid so that Ra of the surfaces thereof is in the range of 0.07 μm to 0.05 μm. In order for the ta-C layers to have the above-described smoothness, the SUS surfaces are formed such that the arithmetical mean height Ra defined by JIS-B0601:2001 is 1.5 μm or less. In the present embodiment, Ra of the SUS surfaces before the protective layers are formed thereon is in the range of 0.5 μm to 0.3 μm.

Deposition Conditions of ta-C Layer

Conditions under which the protective layers (ta-C layers) are formed on the etching grid will now be described. The deposition temperature at which the ta-C layers (protective layers) are formed is preferably 0° C. or more and 350° C. or less, and more preferably, 40° C. or more and 220° C. or less. The deposition rate is set to 1.5 nm/sec. The layer thickness at the discharge-wire side of the grid is 0.05 μm, and the layer thickness at the shutter side (photosensitive-drum side) of the grid is 0.06 μm, which is larger than the layer thickness at the wire side. When the color of the base material differs from the color of the protective layers, the difference in layer thickness can be detected by measuring the optical density. Specifically, SUS has a silver white color with a metallic luster, and the color of ta-C changes from reddish brown to bluish purple (ultramarine), and then to bluish silver in accordance with the layer thickness. Therefore, the deposition thickness can be detected on the basis of color or difference in density. In the case where the protective material is colorless and transparent or when the layer thickness is to be accurately measured, cross section of the grid may, of course, be observed with an electron microscope.

In the case where amorphous carbon (ta-C) is used as the protective material, carbon contained in the protective films has the sp3 structure and the sp2 structure at a predetermined ratio. As a result of studies conducted by the inventors, it has been found that resistances to corrosion and wear can be increased when the proportion of the sp3 structure is greater than that of the sp2 structure.

This is probably because when the proportion of the sp2 structure is large, micropore filling easily occurs between graphite planar layers so that other chemical species (ozone, discharge products, and free radicals in the present embodiment) are easily adsorbed. Although corrosion itself does not largely differ between the two types of structures, the composition ratio is probably affected by corrosion due to other factors (for example, contagious rusting). When the proportion of the sp3 structure is increased, a closely packed nanostructure is formed and the proportion of the crystal structure increases. This probably reduces the negative effects caused by the above-described other factors.

With regard to the composition ratio between the sp3 structure and the sp2 structure in the ta-C layers according to the present embodiment, it has been found through studies that the composition ratio of the sp3 structure to the sp2 structure in the ta-C layers is sp3:sp2±6:4 or more. It has also been found through studies conducted by the inventors that, more preferably, the composition ratio is sp3:sp2=7:3 or more. In the present embodiment, deposition conditions used in the process of forming the surface layers on the grid according to the present embodiment are selected so that the composition ratio of the sp3 structure to the sp2 structure is 7:3. The ratio between the sp3 structure and the sp2 structure of carbon in the protective layers can be detected by using a Raman microscope (for example, RAMAN-11 manufactured by Nanophoton Corporation) or the like. Specifically, Raman scattered light is generated by irradiating the ta-C layers with a laser beam, which is monochromatic light and serves as a light source, and is detected with a spectroscope or an interferometer to obtain a spectral distribution. The ratio between the sp3 and sp2 structures can be calculated on the basis of the peak of the obtained spectrum.

With regard to the deposition conditions for changing the composition ratio, a laser ablation method described in Japanese Patent Laid-Open No. 2005-15325 or a radio-frequency magnetron sputtering method described in Surface Science, Vol. 24, No. 7, pp. 411-416 may be used instead of the FCVA method. Accordingly, protective layers having various composition ratios can be formed by adjusting the substrate temperature, pulse voltage, assist gas flow rate, type of ambient gas, and anneal process temperature.

The deposition process is performed so that the ta-C layers are formed not only on the surfaces facing the discharge wire and the photosensitive member but also on the side surfaces of the grid that are orthogonal to the surfaces facing the discharge wire and the image bearing member. Accordingly, adhesion of the discharge products and aerosols and negative effects thereof can be reduced. In the present embodiment, the ta-C layers having a thickness of 0.02 μm or more are formed on the side surfaces of the grid that are orthogonal to the surfaces facing the discharge wire and the image bearing member.

In the present embodiment, the ta-C layers are formed so that the arithmetical mean height Ra, which is defined by JIS-B0601:2001, of the surfaces thereof is 2.0 μm or less. Since the ta-C layers are formed as the surface layers of the plate-shaped grid, not only the resistance to corrosion but also the resistances to wear and adhesion can be set to appropriate values. Accordingly, not only image defects due to corrosion of the grid but also those due wear and adhesion of foreign matters can be suppressed for a long time. Although the surface layers are preferably made of ta-C, other materials may instead be used.

Relationship Between Shutter and Thicknesses Layers on Grid

The corona charger 2 according to the present embodiment includes the shutter that covers the opening. The shutter 210 moves into the gap between the grid and the photosensitive drum 1 to suppress adhesion of the discharge products to the photosensitive drum. Since the distance between the grid 206 and the photosensitive drum 1 is about 1.5 mm, there is a possibility that the sheet-shaped shutter, which moves through the gap, will come into contact with the grid 206. The shutter 210 is preferably arranged so that it comes into contact with the grid since the amount of leakage of the discharge products to the outside of the charger can be reduced.

When the opening is covered with the shutter, the discharge products adhere to the grid-side surface of the shutter. Therefore, when the shutter having the discharge products thereon contacts the grid, the discharge products transfer from the surface of the shutter that faces the grid to the surface of the grid that faces the shutter. As a result, the surface of the grid that faces the shutter is affected by the discharge products.

In the present embodiment, to reduce costs, carbon is supplied from one side of the grid and caused to flow to the back side of the grid through the mesh section so that layers are formed on both sides of the grid. Therefore, as described above, the thickness of the protective layer on the front surface toward which the protective material is blown is greater than that of the protective layer on the back surface. Accordingly, vapor deposition is performed while the surface of the grid that faces the member to be charged is at the front side, so that the layer thickness at the member-to-be-charged side of the grid is greater than that at discharge-electrode side.

Specifically, as described above, the thickness of the ta-C surface layer on the surface of the grid that faces the discharge wire is set to 0.05 μm, and that on the surface that faces the photosensitive member (shutter) is set to 0.06 μm. Accordingly, the influence (mainly corrosion) of foreign matters, such as the discharge products, scattered toner, and external additives, that have adhered to the shutter on the surface of the grid that faces the shutter can be suppressed for a long time.

4. Durability Evaluation of Grid

The result of the evaluation test performed by using the image forming apparatus structured as described above will now be described. A detailed description is provided below.

Test Conditions and Evaluation Criterions

The tests described below were performed by using a color copier imagePRESS C1 manufactured by CANON KABUSHIKI KAISHA in which a corona charger including a grid, a cleaning brush, and a shutter is installed. Grids having ta-C layers with thicknesses in the range of 20 to 80 nm on the surfaces facing the discharge wire and ta-C layers with thicknesses in the range of 20 to 100 nm on the surfaces facing the photosensitive drum were used for the evaluation.

With regard to the test process (conditions), a discharge step of applying a total current of 1,000 μA to the discharge wire and a voltage of −800 V to the grid for 12 hours in a high-temperature, high-humidity environment (temperature 30° C., humidity 90%) and a leaving step of leaving the shutter in the closed state for 12 hours were repeated for 480 hours in total. In the discharge step, the cleaning operation of cleaning the grid with the cleaning brush was performed every 1 hour.

In this test environment, the grid was evaluated every 96 hours. Specifically, the contamination level of the ta-C layers was evaluated in terms of output images, surface observation with an optical microscope, and surface roughness.

Test Result

Halftone images and the like were formed by using the charger used in the above-described corona discharge test, and the images and the plate-shaped grid were evaluated. Grids having ta-C layers with thicknesses in the range of 20 to 50 nm on the surfaces facing the discharge wire and ta-C layers with thicknesses in the range of 20 to 100 nm on the surfaces facing the photosensitive drum were produced for the test.

The test result showed that satisfactory image and contamination level evaluation results can be obtained when a ta-C layer having a thickness of 40 nm or more is formed at the discharge-wire side and that having a thickness of 50 nm or more is formed at the photosensitive-drum side. The test result also showed that, more preferably, satisfactory durability can be achieved when the layer thickness is 50 nm or more at the discharge-wire side and 60 nm or more at the photosensitive-drum side.

Preferably, when the grid is replaced, the contamination levels of the surfaces at the discharge-wire side and the photosensitive-drum side become NG at the same time. This is because to replace the grid while the contamination level of one of the surfaces thereof is still OK means that the corresponding surface layer on the grid is unnecessarily thick.

When the thicknesses of the protective layers are too large, separation of the protective layers (ta-C layers) from the base layer (SUS) and bonding easily occur. In addition, the time required for the deposition process increases and the amount of consumption of the deposition material (protective material) unnecessarily increases. Therefore, the cost for forming the protective layers on the grid increases. Specifically, in the case where the ta-C layers are formed as the protective layers, the deposition process becomes difficult when the layer thickness is 170 nm or more. Therefore, for this reason and to reduce the amount of deposition material and deposition time, the deposition thickness is preferably 170 nm or less.

Difference in Thickness Between Protective Layers

To maintain the contamination level below a level corresponding to the state in which a small amount of foreign matters are on the grid surfaces, the thickness of the ta-C layer at the discharge-wire side needs to be more than 20 nm, and that at the photosensitive-drum side needs to be more than 30 nm. This is probably because the thickness of the protective layer at the photosensitive-drum side of the grid needs to be large since corrosion is caused also by the discharge products that have adhered to the shutter. The layer thickness at the discharge-wire side of the grid may be 20 nm or more and 170 nm or less, and that at the photosensitive-drum side may be 30 nm or more and 170 nm or less.

Accordingly, the inventors studied the ratio between the thicknesses of the protective layers at the discharge-wire side and the photosensitive-drum side of the grid. As a result, it has been found that the contamination level of the protective layer at the photosensitive-member side does not leave an allowable range thereof earlier than that of the protective layer at the discharge-wire side when the thickness of the protective layer at the discharge-wire side is at least 1.1 times that of the protective layer at the photosensitive-member side or more.

When variations in environmental conditions (mainly variations in current that flows through the discharge wire) are additionally considered, the thickness of the protective layer at the photosensitive-member side of the grid is preferably in the range of 1.1 to 1.8 times (more preferably, 1.1 to 1.6 times) that of the protective layer at the discharge-wire side. In the above-mentioned ranges, the contamination levels of the surfaces at the discharge-wire side and the photosensitive-member side increase substantially synchronously. Accordingly, the deposition time can be reduced by performing the deposition process so that the thicknesses of the protective layers are within the above-described ranges.

When the protective layers (surface layers) wear and the remaining layer thickness becomes smaller than or equal to a certain value, corrosion and adhesion of foreign matters occur from the thinned regions, although this depends on the materials of the base member and the protective layers. The corrosion and adhesion of foreign matters lead to non-uniform charging, and images with non-uniform density are formed as a result.

Therefore, the thicknesses of the protective layers are preferably determined in consideration of, for example, the base member of the grid, the material of the coating on the grid, the material of the shutter, and the number or times the shutter is operated.

In the present embodiment, the thickness of the ta-C layer at the discharge-wire side of the grid is set to 0.05 μm and that of the ta-C layer at the photosensitive-member side is set to 0.06 μm in consideration of the test results. Accordingly, the occurrence of non-uniform charging can be reduced for a long time at low cost while reducing the occurrence of image deletion with the shutter.

Second Embodiment

In the present embodiment, a structure will be described which includes a fan and a heater for reducing the influence of discharge products generated in a corona charger during a discharge process in an image forming operation. Components having substantially the same structure as those in the first embodiment are denoted by the same reference numerals and explanations thereof are thus omitted.

An image forming apparatus according to the present embodiment includes a heater (not shown) that serves as heating means for heating a photosensitive member and a fan (not shown) that serves as blower means for causing air to flow into the corona charger 2. The heater and the fan are controlled by a control circuit C that serves as control means. The control circuit C maintains the temperature of the photosensitive member at a target temperature (38° C.), and thereby suppresses moisture absorption by the discharge products that adhere to the surface of the photosensitive member. Thus, image deletion can be suppressed.

In addition, the discharge products generated in a region around the discharge wire in the discharge process are discharged to the outside of the apparatus by the fan. Specifically, the fan generates airflow from above the discharge wire toward the photosensitive member through the grid. Owing to the airflow, adhesion of scattered toner to the grid and the amount of discharge products that adhere to the discharge-wire side surface of the grid can be reduced.

Adhesion of discharge products to the shutter can also be reduced by rotating the fan from when the image forming operation is finished to when the shutter is closed. The amount of discharge products, such as NOx, that adhere to the grid 206 and the shutter 210 can be reduced. Therefore, in the present embodiment, a control operation is performed in which the delivery fan is operated not only during the image forming operation but also for a predetermined period after the image forming operation is finished to reduce the amount of discharge products that remain in the charger.

After the image forming operation is finished, the possibility that the shutter will contact the grid can be reduced by rotating the fan at a speed lower than that in the image forming operation while the shutter 210 is being moved so as to cover the opening in the corona charger. However, if the shutter contacts the photosensitive member, there is a possibility that the photosensitive member will be contaminated. Therefore, in the present embodiment, the fan is stopped when the opening in the corona charger is covered with the shutter.

In the case where the fan is controlled so as to blow air in the image forming operation and stop when the opening is covered with the shutter as described above, the discharge products less easily accumulate on the discharge-wire side surface of the grid than in the first embodiment. Therefore, the thickness of the protective layer at the discharge-wire side is preferably further greater than that at the shutter side than in the first embodiment.

An evaluation test regarding density non-uniformity and contamination similar to that in the first embodiment was performed by using the above-described structure. Differences from the first embodiment will be briefly described. A grid having a protective layer with a thickness of 0.04 μm at the discharge-wire side and a protective layer with a thickness of 0.05 μm at the photosensitive-member side will be described as a representative.

In the above-described structure, formation of non-uniform images and image deletion due to contamination of the grid occurred after the number of sheets subjected to the image forming operation exceeded about 500,000. Formation of non-uniform images and image deletion due to contamination of the grid occurred after the number of sheets subjected to the image forming operation exceeded about 400,000.

When a fan and a heater were additionally provided as in the present embodiment, the occurrence of image deletion and image defects due to contamination was suppressed for a long time. In the case where a fan is provided, even when the current that flows through the discharge wire varies, the influence of the discharge products that adhere to the wire-side surface of the grid can be reduced.

Corrosion of a grid due to discharge products can be suppressed for a long time in a structure in which a shutter for suppressing accumulation of the discharge products on a member to be charged is disposed between the grid and the member to be discharged.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

The invention claimed is:

1. A charging device that charges a member to be charged, the charging device comprising:

a discharge electrode;

a housing that surrounds the discharge electrode and has an opening that faces the member to be charged;

a plate-shaped grid provided at the opening so as to face the discharge electrode;

a shutter that opens and closes the opening and contactable to a surface of the grid that faces the member to be charged;

a cleaning member that cleans the grid by contacting a surface of the grid that faces the discharge electrode; and a moving mechanism that moves the shutter in a longitudinal direction of the grid, wherein the grid includes a base member, a first protective layer provided on a surface of the base member that faces the discharge electrode, the first protective layer protecting the base member, and a second protective layer provided on a surface of the base member that faces the shutter, the second protective layer protecting the base member and being thicker than the first protective layer.

2. The charging device according to claim 1, wherein the first protective layer and the second protective layer contain diamond-like carbon, and wherein a proportion of an sp3 structure is higher than a proportion of an sp2 structure in the carbon contained in the first protective layer and the second protective layer.

3. The charging device according to claim 1, wherein the first protective layer has a thickness of 20 nm or more and 170 nm or less, and the second protective layer has a thickness of 30 nm or more and 170 nm or less.

4. The charging device according to claim 1, wherein the first protective layer and the second protective layer have a volume resistance in the range of $1\times10^7$ to $1\times10^9$ Ω·cm.

5. The charging device according to claim 1, wherein a thickness of the second protective layer is in the range of 1.1 to 1.8 times a thickness of the first protective layer.

6. The charging device according to claim 1, wherein the cleaning member is a brush, a pad, or a sheet.

7. The charging device according to claim 1, wherein the shutter is a sheet-shaped shutter.

8. A charging device that charges a member to be charged, the charging device comprising:

a discharge electrode;

a housing that surrounds the discharge electrode and has an opening that faces the member to be charged;

a plate-shaped grid provided at the opening so as to face the discharge electrode;

a shutter that opens and closes the opening and contactable to a surface of the grid that faces the member to be charged;

a cleaning member that cleans the grid by contacting a surface of the grid that faces the discharge electrode; and a moving mechanism that moves the shutter in a longitudinal direction of the grid, wherein the grid comprising:

a base member;

a first layer provided on a surface of the base member that faces the discharge electrode; and a second layer provided on a surface of the base member that faces the shutter, wherein each of the first layer and the second layer includes a diamond-like carbon, and wherein the second layer is thicker than the first layer.

9. The charging device according to claim 8, wherein a proportion of an sp3 structure is higher than a proportion of an sp2 structure in the carbon contained in the first layer and the second layer.

10. The charging device according to claim 8, wherein the first layer has a thickness of 20 nm or more and 170 nm or less, and the second layer has a thickness of 30 nm or more and 170 nm or less.

11. The charging device according to claim 8, wherein a thickness of the second layer is in the range of 1.1 to 1.8 times a thickness of the first layer.

12. The charging device according to claim 8, wherein the shutter is a sheet-shaped shutter.

* * * * *